United States Patent [19]

Urquhart

[11] 4,019,975

[45] Apr. 26, 1977

[54] HYDROGENATION OF COAL

[75] Inventor: Donald Bremner Urquhart, Cheltenham, England

[73] Assignee: Coal Industry (Patents) Limited, London, England

[22] Filed: Oct. 29, 1974

[21] Appl. No.: 518,787

[30] Foreign Application Priority Data

Nov. 8, 1973 United Kingdom ..... 51930/73

[52] U.S. Cl. ..... 208/10

[51] Int. Cl.[2] ..... C10G 1/08

[58] Field of Search ..... 208/8, 10

[56] References Cited

UNITED STATES PATENTS

| | | | |
|---|---|---|---|
| 3,586,621 | 6/1971 | Pitchford et al. | 208/214 |
| 3,642,607 | 2/1972 | Seitzer | 208/8 |
| 3,687,838 | 8/1972 | Seitzer | 208/10 |
| 3,694,342 | 9/1972 | Sprow et al. | 208/10 |
| 3,745,108 | 7/1973 | Schuman et al. | 208/10 |
| 3,846,275 | 11/1974 | Urban | 208/10 |
| 3,850,738 | 11/1974 | Stewart et al. | 208/8 |
| 3,909,390 | 9/1975 | Urban | 208/10 |
| 3,920,536 | 11/1975 | Seitzer et al. | 208/10 |
| 3,930,984 | 1/1976 | Pitchford | 208/10 |

FOREIGN PATENTS OR APPLICATIONS

| | | | |
|---|---|---|---|
| 493,307 | 10/1938 | United Kingdom | 208/8 |
| 1,261,707 | 1/1972 | United Kingdom | 208/8 |
| 339,317 | 12/1930 | United Kingdom | 208/8 |

OTHER PUBLICATIONS

U.S. Published Patent Application B 323,568, Seitzer et al., Jan. 28, 1975.

*Primary Examiner*—Delbert E. Gantz
*Assistant Examiner*—James W. Hellwege
*Attorney, Agent, or Firm*—Stevens, Davis, Miller & Mosher

[57] ABSTRACT

The invention relates to the hydrogenation of coal which comprises extracting the coal with a solvent at temperatures and pressures above the critical temperature and pressure of the solvent in the presence of hydrogen and an effective amount of catalyst comprising a salt or oxide of a metal which is not a noble metal and which is liquid or solid at the extraction temperature. The gas phase solvent may then be separated from the solid residue and the hydrogenated products condensed therefrom by cooling.

8 Claims, 1 Drawing Figure

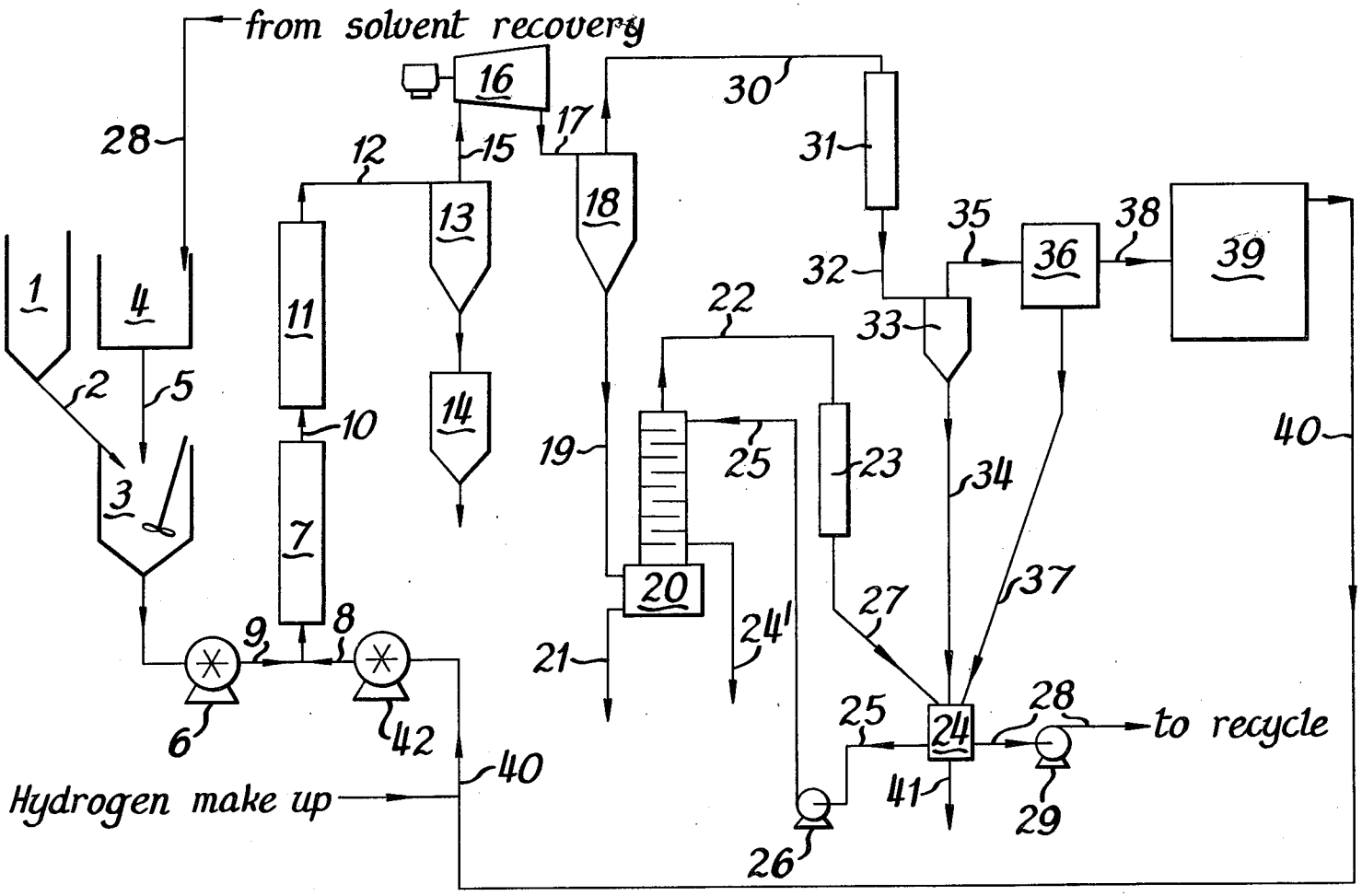
from solvent recovery
Hydrogen make up
to recycle

HYDROGENATION OF COAL

This invention relates to a process for the hydrogenation of coal.

It has been proposed to hydrogenate coal with hydrogen gas in the presence of a solvent and a catalyst. At the temperatures generally employed for such hydrogenation, hitherto above about 300° C, the coal substance breaks down, the molecular chains in the coal being cleaved to form lower molecular weight substances. These products often have a molecular size such that they are suitable for use a fuel oils or the like, and it has been proposed to subject them to hydrocracking, for conversion into "synthetic gasoline". The reactions involved in the breakdown of the coal substance may include both the thermal decomposition of the coal substance in the coal, and the hydrogenative degradation of the coal substance in the coal. In each case, a pitch or tar-like mixture is formed which is liquid at the temperature involved and contains compounds having about 20 or more carbon atoms.

It has also been proposed to treat coal with a solvent at above the critical temperature and the critical pressure of the solvent i.e. in the gas phase whereby similar thermal degradation takes place. The degraded products dissolve in the gas phase of the supercritical solvent. The gas phase can readily be separated from the residual ash and the other portions of the coal, which either have not been degraded or which degraded products are not soluble or have not been dissolved in the gas phase solvent. The extract is then separated from the solvent, for example, by reducing the pressure of the gas phase which often has the effect, particularly if the pressure of the gas phase is diminished to below the critical pressure of the solvent, of reducing the solubility of the extract of the coal in the vapour phase of solvent thus obtained. The reduction in pressure or other separation may be effected in a step-wise manner, and portions of the extract coal condense, if appropriate, in step-wise portions.

It has now been found that if coal is hydrogenated in the presence of certain compounds which are catalysts for the hydrogenation of coal, in the presence of a solvent at above the critical temperature and pressure of the solvent, smaller amount of catalyst is generally required than has hitherto been necessary. Furthermore, the efficiency of the hydrogenative extraction is improved to an extent such that it is not so necessary to take special steps to ensure the efficient contact between the coal, hydrogen and the catalyst, for example, the rocking or shaking of autoclaves or of other similar intensive mixing equipment. It has also been noted that shorter reaction or contact times may be employed, which may result either in an improved throughput or in the use of small reactors. It has further been found that improved extraction efficiency and product separation may be obtained more easily.

According to the present invention, there is provided a process for the hydrogenation of coal which process comprises extracting the coal with a gas phase solvent at a temperature below 550° C in the presence of hydrogen;

and an effective amount of a catalyst comprising a salt or oxide of a metal which is not a noble metal and which is a liquid or a solid at the extraction temperature;

separating the gas phase solvent from the solid residue;

and condensing the hydrogenated products and decomposition products from the gaseous or vapour phase.

Coals are materials formed by degradation of cellulosic material, of plant origin. The degradation has been carried out under varying conditions of heat and pressure. Coals are believed in general to comprise cross-linked carbon structures, of varying degrees of aromaticity, and which structures include various elements other than carbon and hydrogen, in particular oxygen, nitrogen and sulphur. In the formation of coal, in general, oxygen and hydrogen are lost from the coal as the degree of cross-linking increases. The properties of coals vary in accordance, it is believed, with their age and history. The term "coal" is generally used, and is so used in this specification, to include lignites, which are often also known as brown coals, and are relatively younger in the gradual formation of the coal structure.

Advantageously, the coal is employed in a finely divided form. Relatively large lumps may be employed but these give rise to the difficulty that it may be difficult or slow for the soluble constituent of the coal to be extracted from the centre of the larger lumps. Furthermore, in a continuous process, the smaller the particle size the easier is the mechanical handling in the passage of the coal through the pressurizing pumps necessary in order to raise the pressure of the coal and solvent to a sufficiently high level.

Thus it is preferred that the coal particles should pass a 5.0 mm mesh screen and more preferably a 3.0 mm mesh screen. In particular it is preferred that at least 90% and more preferably 95% of the coal particles should pass a 1.5 mm mesh screen.

The coal and the solvent are advantageously mixed at atmospheric pressure. This is chiefly because of mechanical handling problems if superatmospheric pressure is employed; such superatmospheric pressure may however be used if desired. The coal and solvent may be mixed at temperatures that are not very substantially above ambient temperatures. However, as it is normal practice to recycle the solvent, it will not normally be economic to cool the solvent more than is necessary. Thus, depending on the boiling point of the solvent, temperatures of the solvent of up to about 150° C or above may be employed.

By "gas phase solvent" it is to be understood a solvent which at the extraction temperature is above the critical temperature. The solvent may contain "utilisable solvent components" as hereinafter defined which are the effective solvent agents. These "utilisable solvent components" may comprise the whole of the solvent medium or may not be present together with components which do not themselves have a solvent action.

By "utilisable solvent components" is meant a solvent component selected from water, hydrocarbons and organic derivatives of hydrocarbons preferably containing carbon, and hydrogen only, with no other elements, which solvent components have a critical temperature of above about 150° C, and preferably have a critical temperature of below about 450° C. Desirably the critical temperature of such utilisable solvent components is above about 250° C, and it will often be found that the most suitable utilisable solvent components have a critical temperature of less than about 400° C. The utilisable solvent components should desirably be stable at the extraction temperature; that is they should not substantially decompose at or below the extraction temperature; the utilisable solvent components should desirably not react with the coal or the hydrogen or the catalyst or other of the utilisable solvent components under the conditions to which they are subjected. However, it will be understood that some at least of the components of a solvent mixture may at least partially react or decompose. It is the mixture of the utilisable solvent mixture that is in contact with the coal at the extraction temperature, allowing for any such decomposition or reaction, that is to be considered for the purposes of the present invention. In some instances some components of the solvent may not be in the gas phase but may still exhibit a solvent action. It will be understood that any part of the components of the solvent mixture that so reacts or decomposes will not be available to be recycled as itself, but the reacted or decomposed products may, as appropriate, be recycled. In particular, certain aromatic compounds, particularly polycyclic aromatic compounds, may be hydrogenated under the conditions encountered. These hydrogenated compounds may act as hydrogen donors, reacting with the coal substance, and degradation products thereof to donate hydrogen thereto, and may thereby produce an improved yield of hydrogenated product extracted from the coal, thereby acting at least partially catalytically.

The reduced partial pressure of any such utilisable solvent component, $i$, may be its partial pressure $P_i$ at the extraction temperature relevant to its critical pressure $PC_i$, that is $P_i/P_{ci}$. The requirement that the sum of the reduced partial pressures of those utilisable solvent components that are above their critical temperature at the extraction temperature be greater than one is equivalent, for a single substance solvent, to specifying that the single substance solvent is above its critical pressure. A single component solvent may be employed but, in processes carried out on a commercial scale, it is generally more practical and economic to employ a mixture of compounds as solvents. It is to be noted that the solvent medium, if a mixture, is not necessarily wholly either above its critical temperature or even in the vapour phase at the extraction temperature. If the solvent medium contains a significant proportion of a substance whose critical temperature is above the extraction temperature, a portion at least of this substance may dissolve in the supercritical portion of the solvent. A portion of the substance whose critical temperature is above the extraction temperature may remain as a liquid phase; this is not detrimental to the carrying out of the invention in principle, but there may be difficulty in recovering such a portion of the solvent medium. The reaction products, if the extraction temperature is above their critical temperature, may themselves comprise a portion of the utilisable solvent components for the purposes of the invention.

It is, in general, desirable that the sum of the reduced partial pressure of those of the utilisable solvent components having their critical temperatures between 100° C below the extraction temperature and the extraction temperature is at least one. Preferably the sum of the reduced partial pressures of those of the utilisable solvent components having their critical temperatures between 50° C below the extraction temperature and the extraction temperature is at least one. It is believed, from considerations generally taught in the art, for example in Paul and Wise "The Principles of Gas Extraction" published by Mills & Boon Ltd. in London in 1971, that the solvation capacity of a supercritical gas increases as it approaches its critical temperature. Accodingly, it is in general preferred that the utilisable solvent components employed, or as large a proportion of the utilisable solvent components as possible, are close to, but above, their critical temperature.

Solvents that may be employed are preferably those which are stable up to 550° C under the extraction conditions and which have critical temperatures within the ranges stated above. Aromatic hydrocarbons having a single benzene ring and preferably having not more then four carbon atoms in substituent groups may be employed, for example benzene, toluene, xylene, ethylbenzene, isopropylbenzene and tetramethylbenzene. Cycloaliphatic hydrocarbons may be employed, preferably those having at least five and not more than 12 carbon atoms, for example cyclopentane, cyclohexane and cis- and trans-decalin as well as alkylated derivatives thereof. Aromatic hydrocarbons having two aromatic rings may be employed, although it is to be noted that their critical temperatures are relatively high, for example naphthalene, having a critical temperature of 477° C, methyl naphthalene, having a critical temperature of 499° C, biphenyl, having a critical temperature of 512° C, and biphenylmethane, having a critical temperature of 497° C. Acyclic aliphatic hydrocarbons, preferably those having at least five and not more than 16 carbon atoms may be employed, for example the hexanes, octanes, dodecanes and hexadecanes, the last having, for example, a critical temperature of 461° C. Such aliphatic hydrocarbons are preferably saturated; the corresponding alkenes would tend to be hydrogenated under the extraction conditions. Phenols, preferably those derived from aromatic hydrocarbons having up to eight carbon atoms may be employed, for example phenol, amsole and xylenol, although the phenolic hydroxyl group may be liable to be reduced under the extraction conditions. Heterocyclic amines may also be employed.

The hydrogen that is employed for the extraction need not be pure, and can, for example, be formed by the reaction of steam with carbon, which carbon is preferably in the form of coke. In particular, there may also be present in the vapour phase carbon monoxide which may react with water under reaction conditions to produce hydrogen. The amount of hydrogen desirably present will depend on the manner in which the coal is contacted with the hydrogen. If the process of the invention is carried out in a batchwise manner, there will need to be sufficient hydrogen present initially or introduced during the hydrogenation to ensure tht there is sufficient reaction of hydrogen with the coal substance. However, if the process of the invention is carried out by passing a stream of gas over the coal, the amount of hydrogen in contact with the coal at any one time will be lower, although, in total, there should be sufficient hydrogen to ensure sufficient hydrogenation of the coal.

It is believed that, in general, the yield of produce is a linear function of the amount of hydrogen consumed. However, a proportion of the hydrogen reacts to form water and methane, as well as other gases. As a general indication, the amount of hydrogen that it is convenient to employ for reaction is between 5% and 7% relative to the coal, but a range of between 2% and 10% may easily be used. A range of partial pressures that it is convenient to employ for the hydrogen in a gas stream is between 70 atmospheres and 300 atmospheres, but a range of between 30 atmospheres and 300 atmospheres is often practical.

The proportion of extractant to coal is preferably within the range of two to thirty times the weight of the coal. The ratio is desirably held at a low ratio (below about 10/1) for convenience of handling. In general, the more solvent that is present, the more reaction products are extracted from the coal, until an extractibility limit is attained. This is a normal effect in general in a solvent extraction processes. To a certain extent the requirement that the sum of the reduced partial pressures of those utilisable solvent components which are above their critical temperatures at the extraction temperature is at least one is a requirement that there should be a sufficiently high concentration of the solvent present.

Accordingly, a continuous process has an advantage, especially if the gas phase moves relative to the col and the catalyst. The relative velocity advisable in particular cases is difficult to specify but such determinations are a matter of normal chemical engineering practice. The movement of the coal and the gas phase solvent is preferably counter-current in an extraction zone; but alternatively, the movement may be concurrent. A further type of reactor that may be employed involves a bed of a mixture of catalyst and coal moving along an elongate reaction zone, the solvent and hydrogen being introduced below the bed and passing upwardly through the bed and being removed from above the bed, or vice versa.

Any salt or oxide of a metal other than a noble metal that is a catalyst for the hydrogenation of coal may be employed in the invention. Particularly suitable catalysts include the salts, especially the halides, of which the chloride is generally used, or tin, zinc and arsenic. In conjunction with such catalysts it is often found that a promoter which may have no catalystic ability, will greatly improve the catalytic ability of such salts, and ammonium chloride appears to be a useful promoter in conjunction with such catalysts. Salts of other metals that may be suitable for use as coal hydrogenation catalysts for such use are salts of antimony, bismuth, titanium, gallium and mercury.

The salts are Lewis acids and the presence of Lewis bases may poison the catalyst. Lewis bases include amines and nitrogenous oramic compounds in general which are generally reduced to amino-group containing compounds under the extraction conditions. For this reason nitrogen-containing organic compounds are unsuitable for use as the solvent with these metal salt catalysts. Sulphur compounds often also poison these Lewis acid catalysts, and should desirably be excluded, or at least be of low concentration, in the solvent.

Oxides or sulphides of the aforementioned metals may be used as catalysts, but preferred oxide catalysts are those of the transition metals, other than the platinum metals, conveniently those of Groups VI, VII and VIII of the periodic table, in particular of tungsten, molybdenum, cobalt and nickel, either alone or in mixture, conveniently deposited on a carrier, for example alumina or silica. It is believed that the effective catalysts may be the sulphide rather than the oxide and that there must be a sufficient partial pressure of hydrogen sulphide in order to ensure that the catalyst is retained in its sulphide form. It may be necessary to add sulphur, which will be reduced to hydrogen sulphide, to the coal, but high sulphur coals may contain sufficient sulphur themselves.

The quantity of the catalyst employed is not crucial, but it has been found that it is desirable to use a substantial amount of catalyst. A convenient amount of catalyst in a batch process which may be a guide to its use in a continuous process is between about 15% and about 30% by weight based on the amount of coal. However, as little as 5% of catalyst may be employed in suitable cases, and it may be convenient to employ up to about 60% or more of the catalyst in other circumstances. In particular for supported metal oxide catalysts in a continuous process, a bed in the hydrogenation reactor may contain up to about 90% or 95% by volume of catalyst.

The times and temperatures involved in the hydrogenation are a matter well within the competance of those of ordinary skill in the art of chemical engineering and is a matter of balancing parameters and desired results found from experiments such as are normally carried out before the construction of such plants. As a general guide, reaction times for hydrogenation are between 15 minutes and 45 minutes at 400° C. However, times as short as 3 minutes or as long as 2 hours may be used; temperatures of as low as 340° C or as high as 480° C may be used.

Following is a description by way of example with reference to the accompanying drawing of a method of carrying the invention into effect.

The drawing is a schematic drawing of the apparatus and does not show, in particular, heat exchangers and other equipment that would be used in a commercial plant.

The coal, crushed to such a size that it passes through a sieve having a mesh separation of 1.5 mm and containing less than about 10% water is introduced from coal hopper 1 through feed line 2 into a stirred mixing tank 3. Solvent, a toluole liquor produced in a tar distillery consisting mainly of toluene, at atmospheric pressure and about 30° to 50° C is introduced from solvent holding tank 4 through feed line 5 into the stirred mixing tank 3. The coal and solvent are fed into the stirred mixing tank 3 in appropriate ratios, typically between 4 and 10 parts by weight of solvent for each part of coal, and mixed to form a slurry.

The slurry from the stirred mixing tank 3 is pumped by pressurising pump 6 through feed line 9 into heater 7; a stream of hydrogen is also introduced by pressurising pump 42 through feed line 8. The rate at which hydrogen is introduced will typically be about one part by weight of each six parts of coal, but it is understood that the exact ratio chosen will be determined in accordance with both the extent of hydrogenation desired and the design of reactor 11. The mixture of hydrogen gas and slurry enters the heater 7, in which the flow is turbulent, and in which the temperature of the gas/slurry mixture is raised to 420° to 450° C.

The mixture of gas and slurry leaves the heater by feed line 10 which introduces it to the reactor 11. The pressures developed by the pumps 6 and 9 will be arranged so that the pressure of the gas/slurry mixture in reactor 11 is about 200 atmospheres, although a range of pressures of from about 150 to about 300 atmospheres may be appropriate depending on the solvent, the type of catalyst used and the degree of hydrogenation required.

The catalyst, in the form of pellets or extrudates, consisting of mixed cobalt and molybdenum oxides on alumina, is retained in the reactor 11 in the form of a fixed or fluidised bed. The gas and slurry mixture remains in the reactor for a mean residence time, calculated for solvent only, in a range typically of from 10 to 30 minutes. The hydrogenation reactions occurring will normally be exothermic, and there will be a tendency for the temperature to rise. Where the ratio of solvent to coal is large, and the extent of hydrogenation required is limited this temperature rise will be small, and no special steps need to be taken to control it. Where the ratio of solvent to coal is small and extensive hydrogenation is required it may be necessary to remove heat from the reactor 11 employing suitable cooling means (not shown); in such a case it is desirable to employ a fluidised bed of catalyst which may aid heat transfer.

The mixture in the reactor 11, consisting mainly of gas, solvent, dissolved hydrogenated coal and the residual undissolved portion of the coal is removed from the reactor 11 through the feed line 12, entering the separator 13 where the residue, which is a solid or fluid material, relatively more dense is removed from the vapour phase by a cyclone or similarly acting device. The residue is collected in hopper 14, from where it may be removed for disposal. It will commonly be desirable to use some or all of this residue as a fuel to provide process heat, and possibly also as a raw material for the manufacture of the hydrogen needed for the process.

On leaving the separator 13 the cleaned vapour phase passes through line 15 to a pressure reducing device 16. This device may be simply a throttling valve, but it will preferably be a turbine so that useful energy may be extracted from the vapour phase as it is expanded. The pressure to which the vapour phase is expanded is determined by the characteristics of the remainder of the equipment though which it has to pass. It may be desirable for this pressure to be as high as one to three atmospheres in order to effect economies in subsequent recompression of the recycle gas. The temperature of the vapour phase will also fall as it passes through the pressure reducing device 16 to about the boiling point of the solvent at its final pressure. Extract condenses from the vapour phase, and some of the solvent may condense to the liquid state; this will depend inter alia, on the amount of energy removed by the pressure reducing device 16.

The mixture of gases, solvent vapour, solvent liquid and reaction products leaving the pressure reducing device 16 passes through line 17 to a separating device 18, preferably a cyclone. In the separating device 18, the denser liquid materials, mainly reaction products and liquid solvent, are separated from the gas phase and passed down line 19 to a combined still and fractionating column 20. In this still 20, volatile materials are driven off the extract by heating to a temperature of about 150° C in the liquid phase at an overhead pressure of about 60 Torr. The hot liquid reaction products are run off the base of the still through product line 21 to cooling and storage equipment (not shown) and for subsequent processing.

The solvent vapour passes out through the fractionating column through line 22 to a condenser 23. Any higher boiling materials that might have been formed in the process and might tend to contaminate the solvent are removed from the fractionating column at the appropriate level through line 24; and from the low boiling range of the product materials. Solvent condensed in condenser 23 passes through line 27 to separating tank 24. Part of the solvent in separating tank 24 is re-circulated through line 25 and pump 26 to the fractionating column 20, while the excess solvent is returned through lines 28 and pump 29 to the solvent holding tank 4. Water separated by gravity from the solvent in separating tank 24 is removed via line 41.

Gas and solvent vapour leaving the separating device 18 is carried through line 30 to cooler 31 where its temperature is reduced to 20° to 40° C. Solvent and water condense and pass out of the cooler 31 via line 32 with the cooled gas. In separating device 33, conveniently a cyclone, a liquid solvent and water is separated from the gas stream and pass down line 34 to the separating tank 24. The gas leaving separating device 33 carries a mist of solvent along line 35 to a mist entraining device 36. This may be an electrostatic precipitator, but will preferably by a fibre filter of a type appropriate to this duty. The solvent recovered from separating device 36 passes along line 37 to separating tank 24. Clean gas leaving separation device 36 by line 38 passes to a gas purifying plant indicated generally by 39. This would employ known processes to reduce the concentration of permanent gases other than hydrogen to a level at which the cleaned gas may be recycled through line 40 and pump 42 to the process. Gases which may require partial or substantially complete removal may include carbon dioxide, hydrogen sulphide, ammonia and methane. It may be desirable to separate hydrocarbons having between two and four carbon atoms from the gas stream as a saleable product, or as a feed to a plant for producing hydrogen. In general however, hydrocarbons with more than one carbon atom will be present in small quantities unless the process is being operated at high temperatures and with a catalyst of low to medium activity.

The following examples illustrate the invention.

All pressures in the specification are gauge pressures and all the proportions are by weight, unless a contrary intention is specified.

EXAMPLE 1

A stirred autoclave of 5.6 liter capacity was loaded with the following:

| | |
|---|---|
| Coal | 400g |
| Toluene | 2000g |
| Cobalt & Molybdenum Oxides on alumina catalyst | 200g |
| Sulphur | 10g |
| Hydrogen initial pressure (when cold) | 100 atmospheres |

The coal was a Markham Main coal, crushed to below 3 mm and having a volatile matter content of 36% on a dry ash-free basis, and containing 4% ash and 8% moisture. The catalyst comprised a mixture of 3.5% cobalt oxides and 12.5% molybdenum oxides on alumina, in the form of cylindrical extrudates of about 1.5 mm diameter. The sulphur was added to promote rapid and sufficient sulphiding of the catalyst.

The autoclave and the content were heated to 425° C in 200 minutes with continuous stirring. At this stage the pressure was 280 atmospheres. Stirring was maintained for about 120 minutes at this temperature, by which time the pressure had fallen to 240 atmospheres. The stirring was then stopped and the vapour phase was vented through a condensing and mist collecting system to room temperature and pressure. The venting took 60 minutes, during which time the autoclave temperature was held at 425° C.

The hydrogenated products from the coal were recovered by distilling the condensate at 150° C and 60 torr. The residual extracted products amounted to 46% by weight of the dry coal fed. The recovered solvent exceeded the solvent added by 2.5% of the dry coal fed. The hydrogenated products were liquid at room temperature and had an average molecular weight of 280. The following table sets out the ultimate analysis of the coal and the hydrogenated products.

| | Coal | Products |
|---|---|---|
| C | 83.2 | 88.8 |
| H | 5.0 | 7.9 |
| O | 8.7 | 1.7 |
| N | 1.8 | 1.2 |
| S | 1.4 | 0.03 |

EXAMPLE 2

The following constituents were added to the same autoclave as in Example 1.

| | |
|---|---|
| Coal | 363g |
| Moisture | 36g |
| Zinc Chloride | 80g |
| Toluene | 2000g |
| Hydrogen (initial pressures) | 105 atmospheres |

The autoclave was heated to 345° C and maintained there for 2 hours. The maximum pressure during the reaction was about 260 atmospheres. The hydrogenated products were then collected as described in Example 1. The products amounted to 132g and had a molecular weight of 280.

EXAMPLE 3

Different coal types were subjected to extraction under the following conditions:

| | |
|---|---|
| 400° C, 2 hours | |
| Dry coal | 100% |
| Zinc chloride catalyst | 22% |
| Toluene | 550% |
| Initial hydrogen pressure (cold) 1500 psig. | |

Extraction carried out in 5 liter autoclave, as in Examples 1 and 2.

| | | Results | | |
|---|---|---|---|---|
| | | | Yield, % dry coal | |
| Run | Coal | Coal rank | Extract | Residue, including catalyst |
| a | Markham Main | 802 | 44 | 53 |
| b | Hapton Valleys | 301 | 42 | 61 |
| c | Desford | 902 | 44 | 58 |
| d | Haig | 501 | 33 | 74 |
| e | West Cannock | 801 | 35 | 69 |
| f | Victoria | 701 | 38 | 65 |
| g | German brown coal | | 47 | 42 |

EXAMPLE 4

Run (a) of Example 3 was repeated. At the point where the 120 minute contacting period had been completed and the outlet valve was opened to vent the gas phase, additional toluene was pumped into the autoclave at a rate sufficient to maintain the extraction pressure. This was continued until the total amount of toluene that had contacted the coal reached 11 times the dry coal weight. It was found that the extract yield was 57% of the coal weight.

EXAMPLE 5

Run (a) of Example 3 was repeated using antimony bromide as a catalyst. The yield of extract was 50% of the initial coal weight.

EXAMPLE 6

Run (a) of Example 3 was repeated using pyridine as a solvent. The extract yield was 40% of the coal weight.

I claim:

1. A process for the hydrogenation of coal which comprises mixing the coal with an organic solvent having one or more utilizable solvent components, hydrogen, and a catalyst which is a salt or oxide of a non-noble metal, maintaining the resulting mixture at a temperature above the critical temperature of the solvent and below 550° C whereby the solvent is in the aqueous phase and the sum of the reduced partial pressures of the solvent components is at least one, said catalyst being liquid or solid at said temperature, separating the gaseous phase and residue, and condensing hydrogenated products contained in the resulting separated gaseous phase therefrom.

2. A process as claimed in claim 1, characterized in that the utilizable solvent components are selected from water, hydrocarbons and organic derivatives of hydrocarbons.

3. A process as claimed in claim 1, characterized in that the coal is in particulate form and at least 90% of the coal particles pass a 1.5 mm mesh screen.

4. A process as claimed in claim 1, characterized in that the partial pressure of the hydrogen is in the range of 30 to 300 atmospheres.

5. A process as claimed in claim 1, characterized in that the proportion of utilizable solvent components to coal is 2 to 30 times the weight of coal present.

6. A process as claimed in claim 1, characterized in that the catalyst is an oxide of a transition metal other than platinum metals selected from Groups VI, VII and VIII of the Periodic Table according to Mendeleef.

7. A process for hydrogenating coal which comprises mixing coal with a solvent having one or more utilizable solvent components to form a slurry, mixing the slurry with hydrogen under pressure, heating the mixture of slurry and hydrogen under pressure to a temperature above the critical temperature of the solvent in the slurry but below 550° C and wherein the sum of the reduced partial pressures of the solvent components is at least one, contacting the slurry with a salt or oxide of a non-noble metal catalyst which is liquid or solid at the temperature of the slurry until coal is hydrogenated and dissolved in the gaseous phase, separating the gaseous phase from the resulting residue, reducing the pressure on the aqueous phase until extracted hydrogenated products contained therein condense, and separating the condensation product from the gaseous phase.

8. A process for the hydrogenation of coal by extracting the coal with the solvent in the presence of hydrogen, said process characterized in that the solvent is in the gaseous phase and comprises one or more utilizable solvent components which at the extraction temperature, are above their critical temperatures and have a sum of the reduced partial pressures of at least one and in that the solvent extraction is carried out at a temperature below 550° C. in the presence of hydrogen and in the presence of an effective amount of a catalyst which is a salt of one or more of tin, zinc, arsenic, antimony, bismuth, titanium, gallium and mercury and which is liquid or solid at the extraction temperature, the gas phase solvent is separated from the solid residue, and the hydrogenated products are condensed from the solvent in the aqueous or vapor phase.

* * * * *